US010629397B2

(12) United States Patent
Chibahara

(10) Patent No.: US 10,629,397 B2
(45) Date of Patent: Apr. 21, 2020

(54) CONTACT MEMBER, METHOD FOR PRODUCING THE SAME, AND VACUUM INTERRUPTER

(71) Applicant: Mitsubishi Electric Corporation, Chiyoda-ku (JP)

(72) Inventor: Hiroyuki Chibahara, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 16/078,088

(22) PCT Filed: Jan. 20, 2017

(86) PCT No.: PCT/JP2017/001910

§ 371 (c)(1),
(2) Date: Aug. 21, 2018

(87) PCT Pub. No.: WO2017/168990

PCT Pub. Date: Oct. 5, 2017

(65) Prior Publication Data

US 2019/0051475 A1 Feb. 14, 2019

(30) Foreign Application Priority Data

Mar. 29, 2016 (JP) ..... 2016-066219

(51) Int. Cl.
*H01H 11/04* (2006.01)
*H01H 33/664* (2006.01)
(Continued)

(52) U.S. Cl.
CPC ..... *H01H 33/664* (2013.01); *B22D 19/00* (2013.01); *B22F 3/26* (2013.01); *B22F 7/00* (2013.01);
(Continued)

(58) Field of Classification Search
CPC .. H01H 33/664; H01H 1/0206; H01H 11/048; H01H 33/662; B22D 19/00; B22F 7/00; B22F 3/26; B22F 7/04
See application file for complete search history.

(56) References Cited

U.S. PATENT DOCUMENTS 3,610,859 A * 10/1971 Schreiner ..... B22F 3/11 200/264
3,818,163 A * 6/1974 Robinson ..... C22C 1/0475 218/130
(Continued)

FOREIGN PATENT DOCUMENTS

JP 50-21670 B 7/1975
JP 60-128203 A 7/1985
(Continued)

OTHER PUBLICATIONS

International Search Report dated Apr. 25, 2017, in PCT/JP2017/001910 filed Jan. 20, 2017.

*Primary Examiner* — Truc T Nguyen
(74) *Attorney, Agent, or Firm* — Oblon, McClelland, Maier & Neustadt, L.L.P.

(57) ABSTRACT

A contact member according to the present invention includes: a contact layer composed of a plate-shaped porous body containing a high-melting-point metal as a main constituent and infiltrated with an infiltrant containing a low-melting-point metal as a main constituent; a contact-layer supporting part composed of the infiltrant; and a contact-part holding conductor composed of the infiltrant, wherein, the porous body is provided with an opening at the center of the contact layer and a portion from the opening to the contact-part holding conductor is continuously and integrally molded with the infiltrant.

8 Claims, 9 Drawing Sheets

(51) Int. Cl.

| | |
|---|---|
| ***H01H 33/662*** | (2006.01) |
| ***B22F 3/26*** | (2006.01) |
| ***B22F 7/00*** | (2006.01) |
| ***B22F 7/04*** | (2006.01) |
| ***B22D 19/00*** | (2006.01) |
| ***H01H 1/02*** | (2006.01) |

(52) U.S. Cl.
CPC ..... *B22F 7/04* (2013.01); *H01H 1/0206* (2013.01); *H01H 11/048* (2013.01); *H01H 33/662* (2013.01)

(56) References Cited

U.S. PATENT DOCUMENTS 4,117,288 A * 9/1978 Gorman ..... H01H 33/6642 218/129
4,190,753 A * 2/1980 Gainer ..... C22C 1/0425 218/130
4,501,941 A * 2/1985 Cherry ..... H01H 1/0206 200/265
4,584,445 A * 4/1986 Kashiwagi ..... H01H 1/0203 200/265
4,659,885 A * 4/1987 Kashiwagi ..... H01H 33/6643 218/130
4,743,718 A * 5/1988 Santilli ..... H01H 1/0206 218/130
4,830,821 A * 5/1989 Okutomi ..... C22C 1/0475 419/25
5,409,519 A * 4/1995 Seki ..... H01H 1/0203 75/245
5,557,083 A * 9/1996 Komuro ..... B22F 3/26 218/123
5,697,150 A * 12/1997 Komuro ..... C22C 1/045 164/94
5,852,266 A * 12/1998 Komuro ..... C22C 26/00 218/119
5,972,068 A * 10/1999 Seki ..... B22F 1/0003 200/265
6,326,573 B1 * 12/2001 Falkingham ..... H01H 1/0203 218/123
2005/0092714 A1 5/2005 Kikuchi et al.
2006/0102594 A1 * 5/2006 Kikuchi ..... H01H 1/0206 218/123
2016/0104590 A1 * 4/2016 Campbell ..... H01H 33/66207 218/136

FOREIGN PATENT DOCUMENTS

| | | | |
|---|---|---|---|
| JP | 63-96204 | A | 4/1988 |
| JP | 6-170515 | A | 6/1994 |
| JP | 8-291305 | A | 11/1996 |
| JP | 2005-135778 | A | 5/2005 |
| JP | 2010-86898 | A | 4/2010 |
| WO | WO 96/22170 | A2 | 7/1996 |

* cited by examiner

CONTACT MEMBER, METHOD FOR PRODUCING THE SAME, AND VACUUM INTERRUPTER

TECHNICAL FIELD

The present invention relates to a vacuum interrupter to be applied to a vacuum circuit breaker used for interrupting a current in a power transmission system, etc., a contact member used in the vacuum interrupter, and a method for producing the contact member.

BACKGROUND ART

The vacuum interrupter has a structure in which a fixed electrode and a movable electrode are disposed oppositely on a same axis in an insulated container with its interior kept at a high vacuum. When carrying a current, the fixed electrode and the movable electrode are in contact with each other. When an overcurrent or short-circuit-current occurs, these electrodes are instantaneously opened to interrupt the current.

Contact material used for the contacting portions of the fixed electrode and the movable electrode of the vacuum interrupter is mainly required to have a current-interruption performance and a voltage-withstand performance at an instance of opening electrodes. These performances required for the contact material are properties contradictory to each other; therefore, it is difficult to produce the contact material using a material consisting of a single element. Thus, conventional contact materials have been produced using a material which is a combination of two or more elements.

For example, for the voltage-resistance material, a contact material such as a Cu—W type or a Cu—Cr type is generally used in which copper (Cu) being a high-conductivity material, and tungsten (W) or chromium (Cr) are used. In some cases, for a contact material of a vacuum interrupter requiring a low surge characteristic, a contact material such as a Cu—WC type or an Ag—WC type is generally used in which tungsten carbide (WC) being an electron emission constituent is dispersed in copper (Cu) or silver (Ag) being a high-conductivity material, in order to extend current-break time.

As a method for producing these contact materials, an infiltration method described below is used. First, raw material powder of a voltage-resistance material is molded and sintered into a porous body. Then, an infiltrant composed of Cu, Ag or the like is placed on one side of the porous body and heated at the infiltrant melting point or higher. The melted infiltrant permeates (infiltrates) pores in the porous body. A material plate resultantly obtained for the contact is machined into a required contact shape, to obtain the contact. After machined into the contact shape, the contact is brazed to a copper rod which serves as a conductor for carrying a current. In a case where the ratio of a voltage-resistance material constituent having low wettability to the brazing material is large at the contact surface, the brazing may be insufficient, which sometimes causes the contact to fall off or have a small contact area between the copper rod and the contact.

To cope with this problem, there is a method in which tungsten powder is compression-molded into a porous body (refer to Patent Document 1). In this method, a lower punch to be used has been specially devised to form a recess on the molded medium side in contact with the infiltrant. The porous body is put on the infiltrant; and the infiltrant is heated to infiltrate the porous body, whereby the infiltrant metal remains in the recess. After a finishing process for the sintered medium, the sintered medium is joined to a base metal with a brazing material via a remaining infiltrant layer. Even when the contact part contains a hard-to-join material, this method brings no brazing problem because the infiltrant and the base metal are joined.

PRIOR ART DOCUMENTS

Patent Document

Patent Document 1: Japanese Patent Laid-Open Publication No. S60-128203

SUMMARY OF THE INVENTION

Problems to be Solved by the Invention

For a conventional contact member, a brazing step is essential for assembling a vacuum interrupter, and there has been a problem that the brazing material diffusion into the contact part side causes degradation in the contact performance or increases the contact resistance value depending on the kind of the brazing material. Also, it is necessary for the contact part to have enough strength for the finishing machining; therefore, the contact part has to be excessively thickened more than that having thickness to be actually worn away. This brings a problem that it is hard to reduce overall resistance of the electrode. The present invention is made to solve the problems described above and to obtain a contact member for vacuum interrupters in which it is unnecessary to braze the contact part, and the contact part and a contact-part holding conductor are integrally formed.

Means for Solving the Problems

A contact member production method according to the present invention includes: a step of disposing, in a mold, a porous plate which is composed of a porous body containing a high-melting-point metal as a main constituent and has an opening at its center; a step of placing, on an upper side of the porous plate, an infiltrant containing a low-melting-point metal as a main constituent; a step of melting the infiltrant by heating; a step of letting the melted infiltrant partially pass through the opening; a step of raising the porous plate on an upper side of the melted infiltrant; and a step of solidifying the infiltrant by cooling.

A contact member according to the present invention includes: a contact layer composed of a plate-shaped porous body containing a high-melting-point metal as a main constituent and infiltrated with an infiltrant containing a low-melting-point metal as a main constituent; a contact-layer supporting part composed of the infiltrant; and a contact-part holding conductor composed of the infiltrant, wherein the porous body is provided with an opening at the center of the contact layer and a portion from the opening to the contact-part holding conductor is continuously and integrally molded with the infiltrant, and wherein an average density of the porous body is smaller than the density of the infiltrant, Here, the contact part refers collectively to the contact layer and the contact-layer supporting part.

Another contact member according to the present invention includes; a contact layer composed of a plate-shaped porous body containing a high-melting-point metal as a main constituent and infiltrated with an infiltrant containing a low-melting-point metal as a main constituent; a contact-layer supporting part composed of the infiltrant; and a contact-part holding conductor composed of the infiltrant, wherein the porous body is provided with an opening at the center of the contact layer and a portion from the opening to the contact-part holding conductor is continuously and integrally molded with the infiltrant, and wherein an average density of the porous body is larger than the density of the infiltrant.

Effects of the Invention

According to the present invention, a contact part and a contact-part holding conductor are integrally formed, so that a contact member having a low-resistance and high-reliability can be obtained.

EMBODIMENTS FOR CARRYING OUT THE INVENTION

Hereinafter, explanation will be made using drawings, about embodiments of a contact member for a vacuum interrupter, a method for producing the contact member and a vacuum interrupter according the present invention. Note that in each drawing, the same or equivalent portions are given the same symbols for explanation.

Embodiment 1

Figure 1:
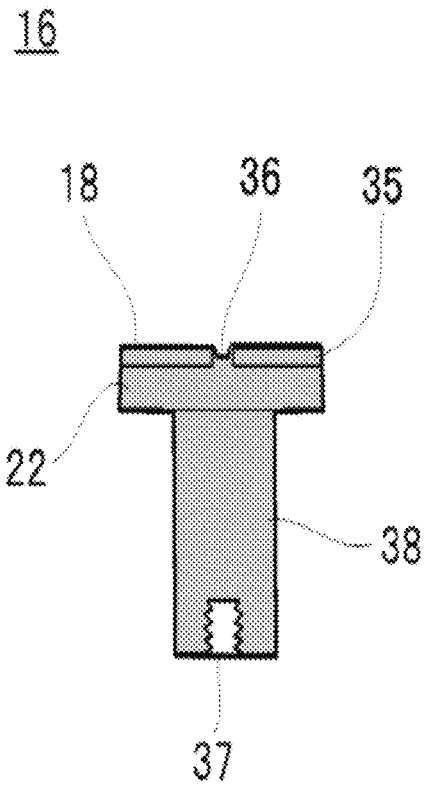
FIG. 1 is a cross-sectional view of a contact member for a vacuum interrupter according to Embodiment 1.
Figure 2:
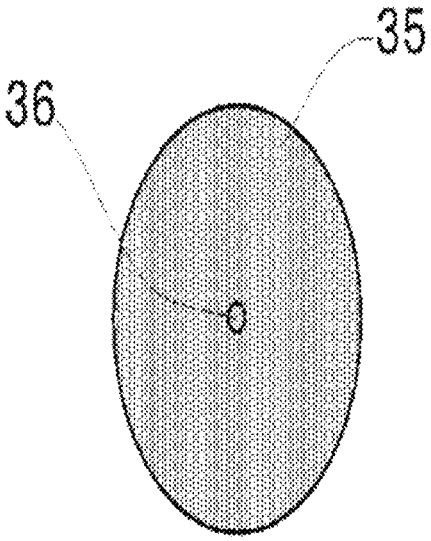
FIG. 2 is a top view of the contact member for a vacuum interrupter according to Embodiment 1.

FIG. 1 is a cross-sectional view of a contact member 16 for a vacuum interrupter according to Embodiment 1 of the present invention. A contact layer 18 is a surface of an infiltrated layer 35 which is a porous body having been infiltrated and whose surface has been ground or shaved through machining, and is normally flat. A contact-layer supporting part 22 is in contact with the infiltrated layer 35, and is a portion to support the infiltrated layer 35. There is a recess 36 at the center of the infiltrated layer 35; the contact-layer supporting part 22 is, as described later, exposed at an opening of the porous body constituting the infiltrated layer 35; the infiltrated layer has a portion sunken from the surface of the contact layer 18. The combination of the contact-layer supporting part 22 and the infiltrated layer 35 (contact layer 18) is a contact part. FIG. 2 is a top view of the contact member 16 shown in FIG. 1, showing that each of the infiltrated layer 35 forming the contact layer 18 and the recess 36 positioned at its center has a round shape. Note that each of the contact layer 18 and the recess 36 may take a shape other than the round shape, such as an ellipse.

A contact-part holding conductor 38 is formed continuously from the contact-layer supporting part 22, to have a function to let, when carrying a current, the current coming from the contact layer 18 flow via the contact-layer supporting part 22. The contact-part holding conductor 38 is provided with a tapped hole 37 at an end opposite to the contact layer 18, so that the contact-part holding conductor 38 can be easily connected to a current-carrying conductor to be connected to the outside of the vacuum interrupter.

Description will be made about materials of the contact member 16. The infiltrated layer 35 is composed of a base material mainly containing copper (Cu) or silver (Ag), and a component whose main constituent has a melting point higher than that of the base material. The contact member 16 has a structure in which the holding conductor composed of the same material as the base material is integrally molded continuously from the infiltrated layer 35. A porous plate from which the infiltrated layer 35 is made, is a plate-shaped porous material which is compression-molded from particles mainly composed of a high-melting point constituent; for the particles, a metal having a melting point higher than that of the base material is normally used.

In order to realize such a configuration, in a producing process of the contact member 16, a porous plate 31 is placed on top of the mold; an infiltrant (pellet 34) to be a base material is placed on the porous plate; and they are heated at the infiltrant melting point or higher, so that the porous plate is infiltrated with the infiltrant, and also the contact-part holding conductor 38 is integrally molded from the infiltrant having flowed down toward the mold bottom through the opening. After the infiltration step, the work piece is machined into the shape shown in FIG. 1 mainly through its surface machining. Thus, for the infiltrant, a metal having a melting point lower than that of the porous plate is used.

Figure 3:
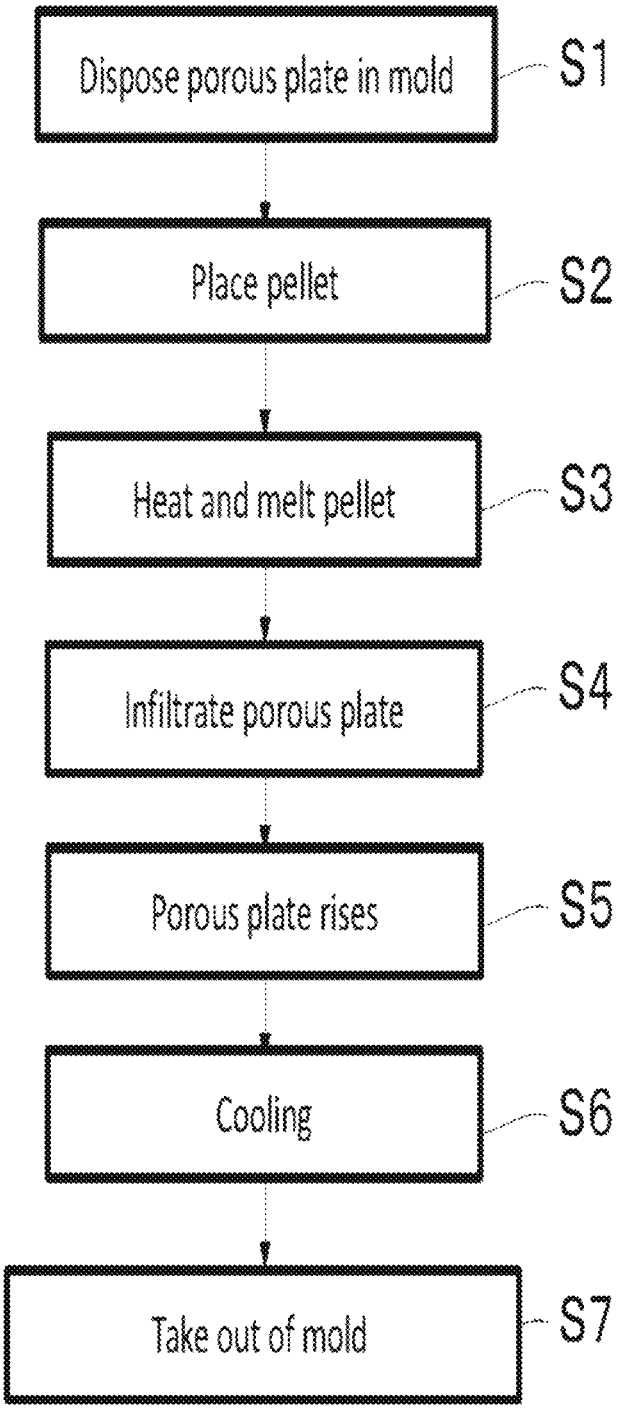
FIG. 3 is a flowchart showing steps in relation to infiltrating the contact member for a vacuum interrupter according to Embodiment 1.

Hereinafter, using FIGS. 3 to 12, a process for producing the contact member 16 according to the present invention will be described in detail. FIG. 3 is a flowchart showing steps in relation to infiltration in a process for producing the contact member 16 for a vacuum interrupter. FIGS. 4 to 11 each are a cross-sectional view or a top view to illustrate the steps shown in the flowchart of FIG. 3.

Figure 4:
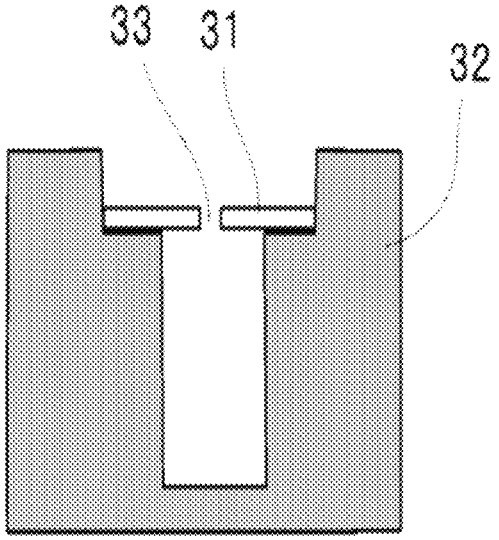
FIG. 4 is a cross-sectional view for illustrating a step of disposing a porous plate in a mold in Embodiment 1.
Figure 5:
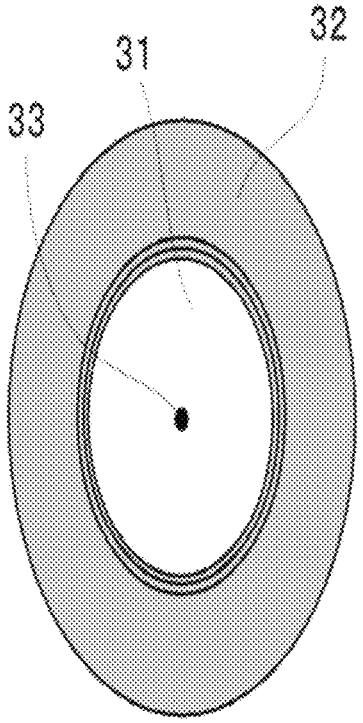
FIG. 5 is a top view for illustrating the step of disposing the porous plate in the mold in Embodiment 1.

FIG. 4 is a cross-sectional view for illustrating a step (Step S1) in which the porous plate 31 is disposed in a mold 32 and FIG. 5 is a top view therefor. In Step S1, the porous plate 31 composed of a compression-molded porous body whose main constituent is high-melting-point metal particles is disposed on a shelf portion of a mold 32 having a step. The diameter of the bottom of the mold 32, which is located under the porous plate 31, is smaller than that of the porous plate 31. With this configuration, it is possible to expand the contact area of the contact layer 18 to reduce the contact resistance in an electrode-closed state; also by molding the contact-part holding conductor 38 to carry a current with its thickness as thin as possible, the amount of infiltrant to be used can be reduced. For the mold 32, a heat-resistant material such as graphite is used. In order to easily take out an electrode after infiltration, a release agent containing BN (boron nitride) as a main constituent is applied to the inner wall of the mold 32.

For compression-molding of powder containing high-melting-point metal particles as a main constituent, the powder, for example, is filled in a usually used press mold to be compression-molded at a predetermined pressure. For the pressure to be applied in the compression molding, no special specification is given, but it is preferable that the pressure is between 50 MPa and 200 MPa. An opening 33 is provided at the center of the porous plate 31. The porous plate 31 may be much thinner than a porous plate which has been compression-molded for producing an infiltrated contact and has a normal thickness between 5 mm and 15 mm. The opening 33 at the center is large enough that when the infiltrant is heated at the melting point or higher to melt, the infiltrant can flow through the opening down into the lower part of the mold. Namely, the diameter of the hole, for example, is 2 mm to 10 mm. A mold may be used which produces a hole at the center of the porous body when molding the porous body. Also, with respect to the sides of the porous plate 31, only a side on which the infiltrant (such as pellet) is put should be flat: the other side which is in contact with the shelf of the mold 32 does not need to be flat.

The porous plate 31 after molding is preliminarily sintered at a temperature higher than a temperature for infiltration to be performed in a later step and lower than the melting point of the high-melting-point metal. In a case, for example, where the high-melting-point metal is Cr and the infiltrant metal is Cu, the temperature range for preliminary sintering is between 1083 degrees C. and 1860 degrees C. For an atmosphere for the preliminary sintering, a non-oxidizing atmosphere such as vacuum or hydrogen is suitable. A required sintering time is a time which would not cause much reduction in size of the sintered body due to over-sintering.

Figure 6:
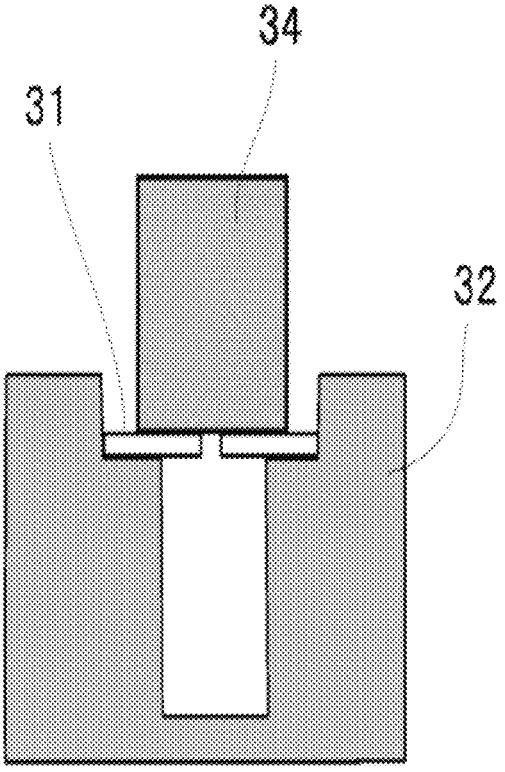
FIG. 6 is a cross-sectional view for illustrating a step of placing an infiltrant pellet 34 in a mold 32 in Embodiment 1.
Figure 7:
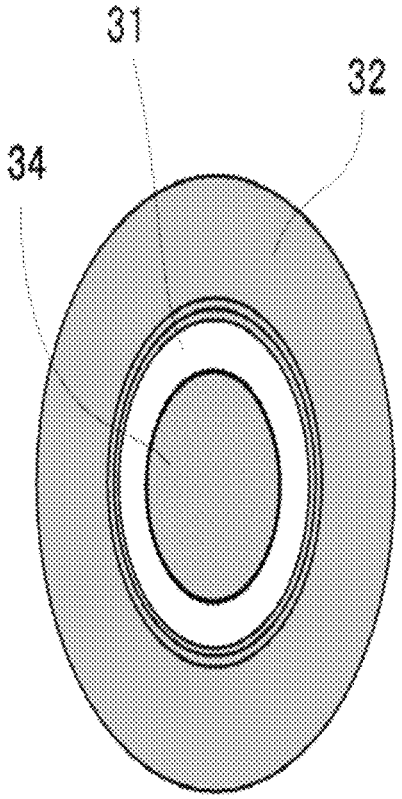
FIG. 7 is a top view for illustrating a step of placing the infiltrant pellet 34 in the mold 32 in Embodiment 1.

FIG. 6 is a cross-sectional view for illustrating Step S2 in which a pellet 34 composed of the infiltrant is placed in the mold 32, and FIG. 7 is a top view thereof. In Step S2, the pellet 34 composed of a metal material to be infiltrated is put on the upper face of the porous plate 31. For example, a lump of Cu or Ag shaped into a round bar or a prism is used for the pellet 34. It is necessary that the volume of the pellet 34 is sufficiently larger than that of the porous plate 31; for example, the volume of the pellet 34 is 2 to 100 times larger. The porous plate 31 and the infiltrant pellet 34 set placed in the mold 32 are heated at a temperature range between the infiltrant melting point and the preliminary sintering temperature, to melt the pellet 34 (Step S3). As the melting proceeds, the liquefied pellet 34 becomes an infiltrant, to infiltrate the porous plate 31 (Step S4).

Note that the infiltration utilizes an action that a liquefied metal serving as infiltrant permeates continuous pores in the porous body by a capillary phenomenon. A melted metal has a tendency that the higher the temperature of melted metal rises above the melting point, the lower the surface tension becomes, thereby giving more fluidity thereto. Larger surface tension is effective to utilize the capillary phenomenon; therefore, it is desirable that the temperature during the infiltration be set close to the melting point. To be specific, it is preferable that the infiltration temperature is 10 to 100 degrees C. higher than the melting point.

Figure 8:
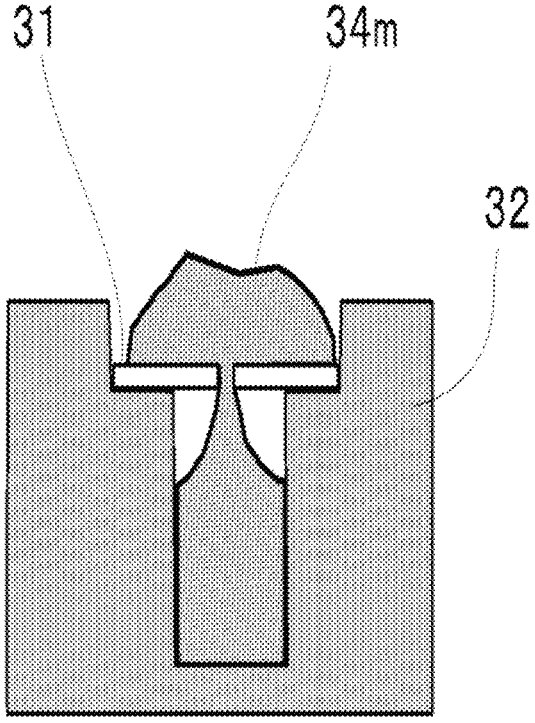
FIG. 8 is a cross-sectional view showing a state in which a melted pellet trickles down to the mold bottom in Embodiment 1.
Figure 9:
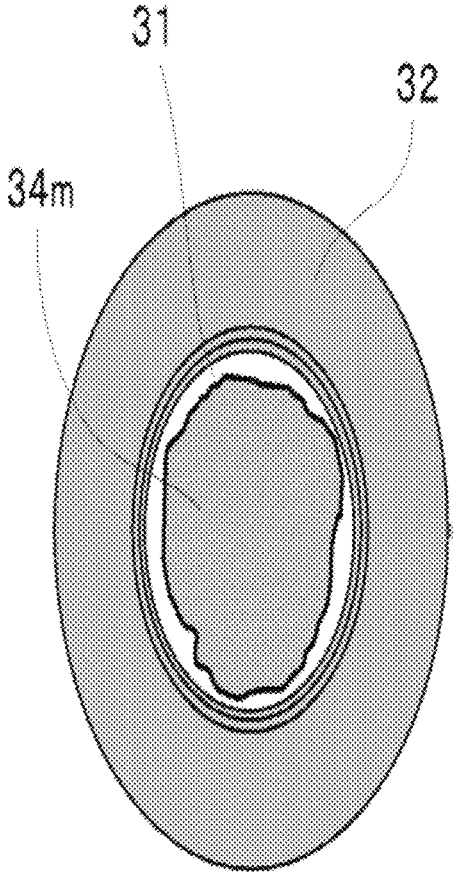
FIG. 9 is a top view showing a state in which a melted pellet trickles down to the mold bottom in Embodiment 1.

When the pellet 34 is melted and becomes liquid, the liquid partially passes through the opening 33 provided at the center of the porous plate 31 to trickle down to the mold bottom, and also serves as infiltrant to infiltrate the porous plate 31. The porous body 31 hereby becomes the infiltrated layer 35. FIG. 8 is a cross-sectional view showing a state in which the melted pellet 34*m* trickles down to the mold bottom. FIG. 9 is a top view corresponding to FIG. 8.

Figure 10:
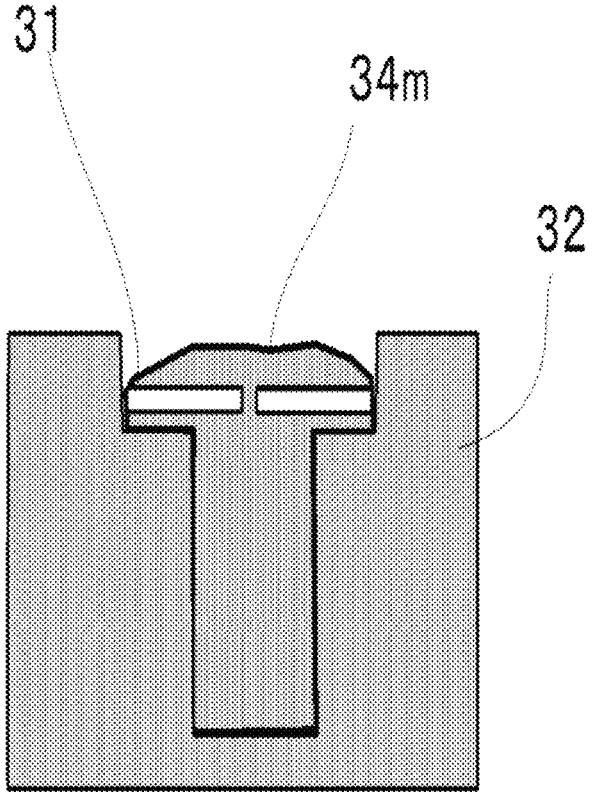
FIG. 10 is a cross-sectional view showing a state in which the melted pellet has filled a space under the porous plate in the mold in Embodiment 1.
Figure 11:
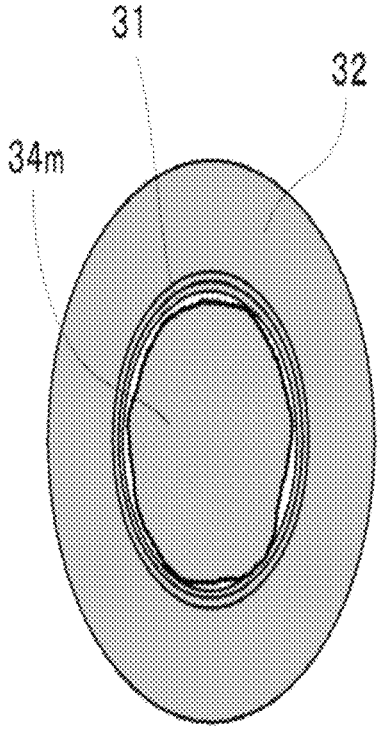
FIG. 11 is a top view showing the state in which the melted pellet has filled the space under the porous plate in the mold in Embodiment 1.

In a case where the average density of the infiltrated porous plate 31 (infiltrated layer 35) is lower than the average density of the infiltrant metal, the porous plate 31 rises, when being left as it is for a while, on a top face side of the melted infiltrant (Step S5). Such a relation holds true in a case, for example, when either one or a combination of two or more from among Cr (average density: 7.19 g/cm3), Ti (4.5 g/cm3), Ni (8.9 g/cm3), V (6.1 g/cm3), Fe (7.87 g/cm3), Co (8.9 g/cm3), and Mn (7.44 g/cm3) is selected for the high-melting-point metal used for the porous body of the porous plate 31, and either Cu (8.96 g/cm3) or Ag (10.5 g/cm3) is selected as the infiltrant metal. Also, a relatively-high-average-density metal such as Mo (10.2 g/cm3), W (19.3 g/cm3) and Ta (16.65 g/cm3) or a high-melting-point metal carbide such as WC (15.6 g/cm3) can be added as long as the added substance will not become the main constituent of the porous body. FIG. 10 is a cross-sectional view showing a state in which the melted pellet 34*m* accumulates on the mold bottom to fill up the space under the infiltrated layer 35. FIG. 11 is a top view corresponding to FIG. 10. In this state, the porous plate 31 slightly rises up from the shelf of the mold 32.

Figure 12:
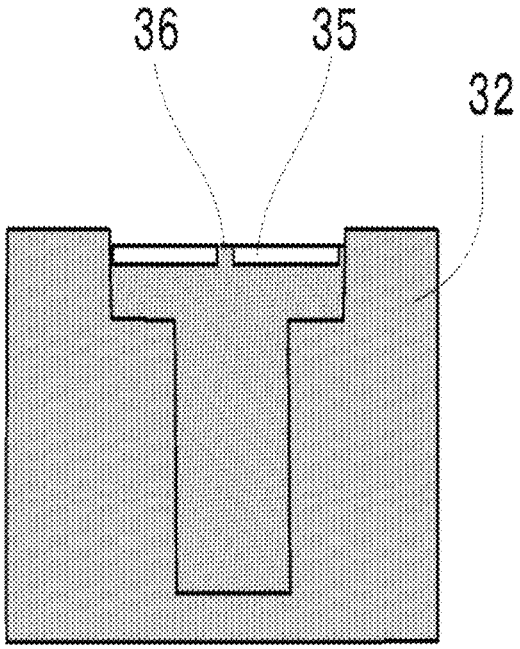
FIG. 12 is a cross-sectional view showing a state in which the contact member has been cooled in Embodiment 1.

Just when the infiltrated porous plate 31 (infiltrated layer 35) rises on the surface of the melted infiltrant, the temperature is decreased for cooling (Step S6). When the infiltrant is cooled and then solidified, the infiltrated layer 35 and an infiltrant thereunder solidified in the mold 32 become integrated as a contact member. FIG. 12 is a cross-sectional view showing a state in which cooling is completed and the porous plate 31 rises on the top face of the infiltrant to become the contact layer 35. The contact member is taken out of the mold 32 (Step S7) to end the infiltration steps.

Further, in order to prevent the infiltrant remaining in the opening 33 at the center of the porous plate 31 from getting in contact and welded with an opposing counterpart contact when setting up into the vacuum interrupter, the infiltrant may be shaved off to form a recess 36 as deep as 0.5 mm or more. The depth of the recess 36 may be properly determined and the infiltrant may be partially removed by a method other than shaving off. Then, processing such as finishing the surface and the side of the contact and forming a tapped hole 37 at the bottom as shown in FIG. 1 is performed, to complete the contact member 16 as an integrally molded product.

When assembling the vacuum interrupter, a brazing step is unnecessary for the contact member 16 according to the present invention; therefore, brazing material does not diffuse into the contact side, preventing the contact performance from degrading. The infiltrated layer 35 can have any thickness as long as it is thicker than the thickness to actually be worn away. This makes it possible to design the infiltrated layer having the minimum necessary thickness, lowering the resistance of the whole electrode. In addition, because the infiltrated layer 35 is supported by the contact-layer supporting part 22, the infiltrated layer 35 can have enough strength to withstand mechanical stress applied in finishing processing.

Embodiment 2

Figure 13:
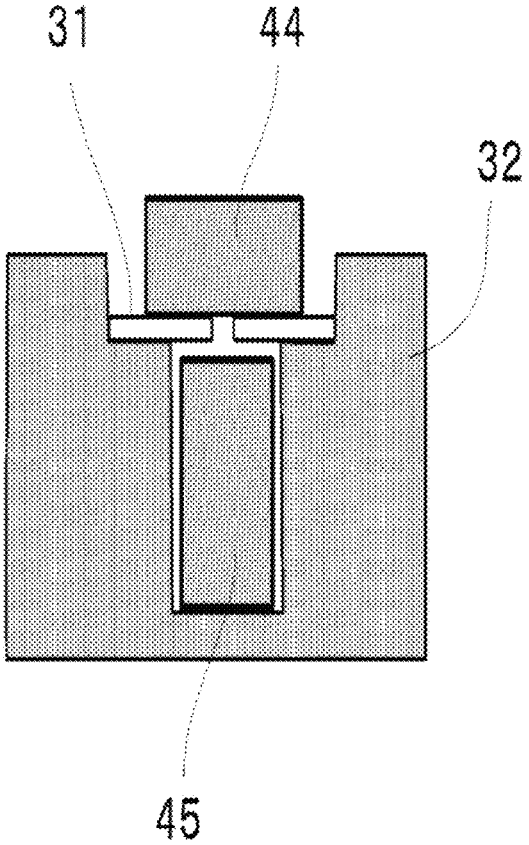
FIG. 13 is a cross-sectional view showing a state in which a porous plate, a small pellet and a bottom pellet are placed in a mold in Embodiment 2.

FIG. 13 is a cross-sectional view showing a state in which the porous plate 31 is placed on the shelf of the mold 32, and a small pellet 44 and a bottom pellet 45 which are to be infiltrant are placed. Embodiment 2 is different in that, instead of the pellet 34, two pellets of the small pellet 44 and the bottom pellet 45 are used. In the heating and melting step, these pellets are melted. The small pellet 44 is liquefied to trickle down from the opening 33 provided at the center of the porous plate 31, and to infiltrate as infiltrant the porous plate 31, which is the same step as described above. Then, the melted small pellet 44 gets in contact and integrated with the melted bottom pellet 45. The states thereafter are the same as in Embodiment 1, therefore the description will be omitted.

As described above, by using these two pellets, volume of the infiltrant to trickle down through the opening 33 can be reduced, which reduces infiltration time to thereby increase the productivity. The completed contact member 16 is the same as in Embodiment 1 and, therefore, the effects to be obtained are common between the embodiments.

Embodiment 3

Figure 14:
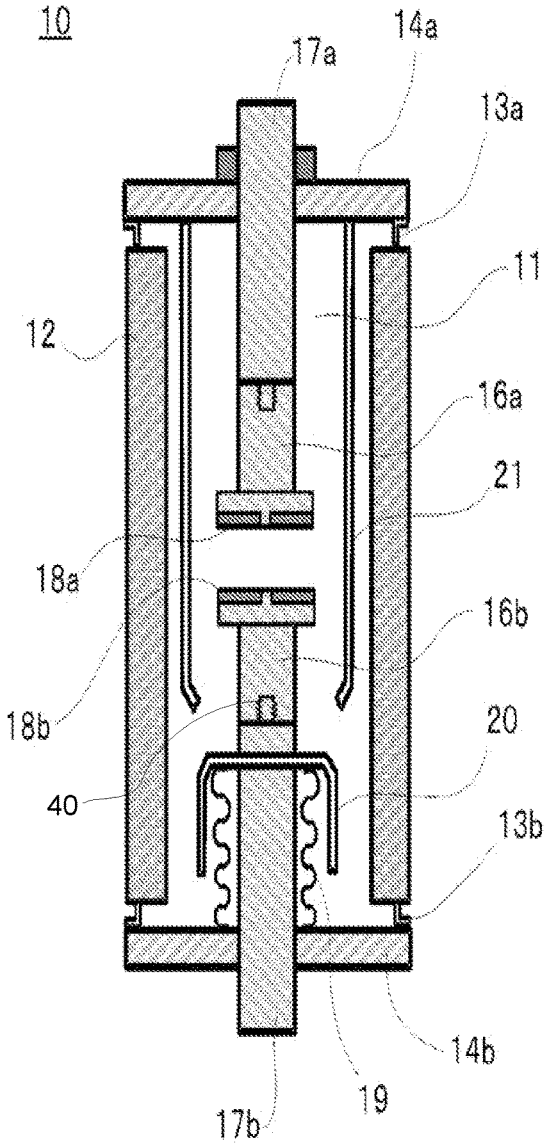
FIG. 14 is a cross-sectional schematic view showing a structure of a vacuum interrupter according to Embodiment 3.

FIG. 14 is a cross-sectional schematic view showing a structure of a vacuum interrupter 10 according to Embodiment 3 of the present invention. In the vacuum interrupter 10, a fixed-element-side contact member 16*a* and a movable-element-side contact member 16*b*, each of which is an integration of a contact and an electrode, are used in pair. For each of these contact members, the contact member explained in Embodiment 1 or Embodiment 2 is used. The envelope of the vacuum interrupter 10 is composed of a cylindrically-formed insulated container 12 and metal lids 14*a* and 14*b* fixed to both ends of the insulated container 12 by metal sealing parts 13*a* and 13*b*, and the envelope is sealed so that the inside thereof is in a high-vacuum state of 1×10-3 Pa or lower.

The metal lids 14*a* and 14*b* are provided respectively with a fixed-element-side conductor 17*a* and a movable-element-side conductor 17*b* each having a round column shape so that the conductors 17*a* and 17*b* will penetrate the centers of the metal lids 14*a* and 14*b*, respectively. In the envelope, tip portions of the fixed-element-side conductor 17*a* and the movable-element-side conductor 17*b* are screw-fitted to the fixed-element-side contact member 16*a* and the movable-element-side contact member 16*b*, respectively. A combination of the fixed-element-side conductor 17*a* and the fixed-element-side contact member 16*a* is referred to as a fixed-element-side electrode. Similarly, a combination of the movable-element-side conductor 17*b* and the movable-element-side contact member 16*b* is referred to as a movable-element-side electrode. As for a method for fitting to the contact members, an engaging structure may be adopted in which brazing is not used. A fixed-element-side contact layer 18*a* and a movable-element-side contact layer 18*b*, which are respectively contacts of the fixed-element-side contact member lea and the movable-element-side contact member 16*b*, are set in parallel to face each other. The movable-element-side conductor 17*b* is provided with a bellows 19, which allows the movable-element-side conductor 17*b* to move in the axis direction with the inside of the vacuum interrupter 10 being kept vacuum and sealed. In FIG. 14, there is a gap between the fixed-element-side contact member 16*a* and the movable-element-side contact member 16*b*, which indicates an electrode-opened state. When the movable-element-side conductor 17*b* moves toward the fixed-element-side, the fixed-element-side contact layer 18*a* and the movable-element-side contact layer 18*b* get in contact with each other to be in an electrode-closed state, in which the fixed-element-side conductor 17*a* and the movable-element-side conductor 17*b* can carry a current.

Over the bellows 19, a metal arc shield 20 for bellows is provided in order to prevent metal vapor produced by arcs generated between the contacts when opening the electrodes from adhering to the bellows. Also, a metal arc shield 21 for the insulated container is provided so as to cover a gap generated in an electrode-opened state of the fixed-element-side contact member 16*a* and the movable-element-side contact member 16*b*. The arc shield 21 for the insulated container is provided to prevent the inner wall of the insulated container 12 from being covered with arc vapor. In an example shown in FIG. 14, it is fixed w the metal lid 14*a*. A space enclosed with the arc shield 21 for the insulated container is an interruption chamber 11.

When the electrodes in a current-carrying state are switched to open, an arc is produced across the gap between the fixed-element-side contact layer 18*a* and the movable-element-side contact layer 18*b*. The arc is produced mostly on outer peripheral sides of both contact members, namely the arc is produced on sides near the arc shield 21 for the insulated container, and is rarely produced at center portions of both contact members. Also, because each center portion is depressed from the contact layer surface, it is less likely that electric field concentration occurs there. Therefore, the arc does not move in a concentrated manner toward the opening 33 provided at the center of the porous plate 31, producing no effect on the current-breaking capacity. Also, because the thickness of the contact layers 18*a* and 18*b* are slightly thicker than those to actually be worn away and no brazing material is used, it is possible to obtain a vacuum interrupter 10 which has a low resistance and a small power loss while carrying current.

EXAMPLES

Hereinafter, examples of the contact member according to the present invention will be described.

Example 1

Cr was used as a main constituent of the porous body. In order to facilitate Cu infiltration, Cu powder whose amount is 10 volume % of the Cr was mixed. The average particle diameter of the used Cr powder was 30 μm and the average particle diameter of the Cu powder mixed therewith was 30 μm. The porosity was 40% of the whole volume of the porous body. A disk-shaped porous plate produced with the porous body had a diameter of 30 mm and a thickness of 3 mm. An opening is provided at the center of the porous plate (center hole diameter) so as to have a diameter of 5 mm.

As for the infiltrant pellet, a round bar was used which had been formed from oxygen-free copper so as to have a diameter of 25 mm and a height (thickness) of 40 mm. A mold was used in which the bottom diameter was 20 mm, the depth from the shelf to the bottom was 35 mm, and the diameter at the shelf was 32 mm. The height from the shelf to the mold's upper edge was 20 mm. The inside of the mold was sprayed with BN powder as a release agent.

The conditions for preliminarily sintering the porous body were that the temperature was 1200 degrees C. and such temperature was maintained for two hours. In a state in which the infiltrant pellet was placed on the porous plate, heating was conducted for infiltration. The temperature during the infiltration was 1100 degrees C., which is slightly higher than the Cu melting point of 1083 degrees C. The infiltration was performed for three hours in a hydrogen atmosphere.

Example 2

The conditions for Example 2 were all the same as in Example 1 except that the diameter of the opening provided to the porous plate was 8 mm.

Comparative Example 1

A porous plate used was a disk with the same thickness, but it differed from Example 1 and had no opening at the center. Except that, the conditions were all the same as in Example 1.

Comparative Example 2

Unlike Example 1, infiltration was conducted with the infiltrant pellet placed under the porous plate. Except that, the conditions were all the same as in Example 1.

Comparative Example 3

A conventional method was used for infiltrating the porous body. The thickness of the porous body was 10 mm and the thickness of the infiltrant was 8 mm. As for the porous plate, a disk with no opening was produced. A mold was used whose shape corresponds to that of the disk. Except that, the conditions for infiltration were all the same as in Example 1. As shown later, brazing was conducted to form a contact member.

The followings are the results after the infiltration process was conducted. In Examples 1 to 4, the infiltrated porous body rose in the mold. In Comparative example 1, the infiltrant Cu overflowed out of the mold before being accumulated enough on the bottom. Also, in Comparative example 2, the porous body was caught on the upper edge of the mold. In Comparative examples 1 and 2, therefore, contact members could not be produced with good reproducibility. In Comparative example 3, infiltration to the porous body was properly conducted. Table 1 lists conditions of the experiments.

TABLE 1

| | Thickness of porous body | Diameter of opening at center | Thickness of infiltrant | Rising of porous body | Infiltrant position against porous plate |
|---|---|---|---|---|---|
| Example 1 | 3 mm | 5 mm | 40 mm | ○ (Rising confirmed) | On porous plate |
| Example 2 | 3 mm | 8 mm | 40 mm | ○ (Rising confirmed) | On porous plate |
| Example 3 | 2 mm | 3 mm | 40 mm | ○ (Rising confirmed) | On porous plate |
| Example 4 | 4 mm | 5 mm | 40 mm | ○ (Rising confirmed) | On porous plate |
| Comparative example 1 | 3 mm | 0 mm | 40 mm | X (Infiltrant overflowing out of mold) | On porous plate |
| Comparative example 2 | 3 mm | 5 mm | 40 mm | X (Caught on upper edge of mold) | Under porous plate |
| Comparative example 3 | 10 mm | 0 mm | 8 mm | — | On porous plate |

Example 3

The conditions for Example 3 were all the same as in Example 1 except that the thickness of the porous plate was 2 mm and the diameter of the opening at the center was 3 mm.

Example 4

The conditions for Example 4 were all the same as in Example 1 except that the thickness of the porous plate was 4 mm and the diameter of the opening at the center was 5 mm.

After infiltration in Example 1 to Example 4, each contact member was machined into the shape shown in FIG. 1. The surface of the porous body was ground approximately by 0.5 mm. The side face thereof was also ground so that the top surface would have a diameter of 28 mm; and the contact-layer supporting part was tapered so that the side face thereof would be at approximately 80 degrees relative to the contact layer surface. A portion to be the contact-part holding conductor was ground so as only to have a smooth surface with its diameter unchanged at 20 mm which was a diameter after the infiltration; and a tapped hole for joint was machined at the end opposite to the contact layer. After that, the contact-part holding conductor was joined with a screw 40 to a conductor (rod) to be pulled out through the metal lid to outside of the vacuum interrupter, and then the joined components were assembled into the vacuum interrupter.

Figure 15:
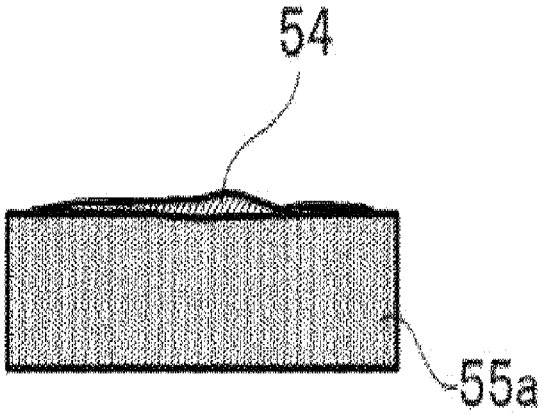
FIG. 15 is a schematic view showing a state after infiltration for Comparative example 3.
Figure 16:
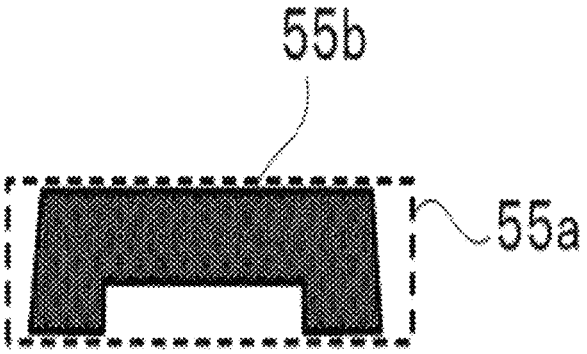
FIG. 16 is a cross-sectional schematic view showing the shape of a porous body after machining for Comparative example 3.
Figure 17:
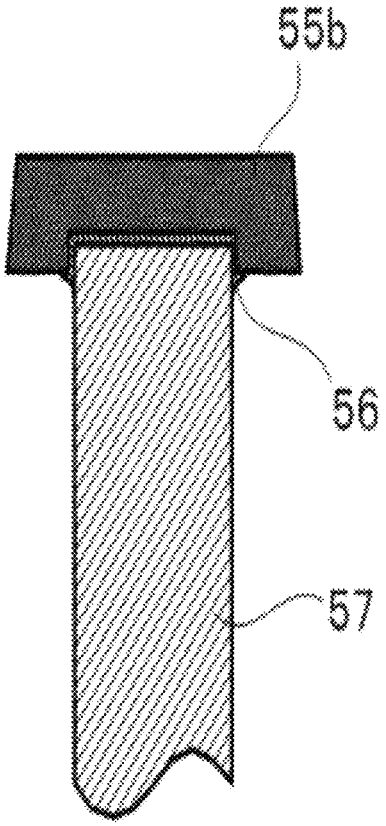
FIG. 17 is a cross-sectional schematic view of a conductor produced using the processed porous body of Comparative example 3.

On the other hand, in Comparative example 3, the top and bottom faces of the porous body were each ground to become 0.5 mm thinner. And, the side of the porous body was, similarly to the previous examples, ground so that the top surface of the contact layer would have a diameter of 28 mm; and the contact-layer supporting part was tapered so that the side face thereof would be at approximately 80 degrees relative to the contact layer surface. FIG. 15 is a schematic view showing a state after infiltration for Comparative example 3, The figure shows that there is an infiltrant 54 which has not been infiltrated and remains on the top face of an infiltrated disk-shaped porous body 55*a*. FIG. 16 is a cross-sectional schematic view showing the shape of a porous body 55*b* after machining for Comparative example 3. The dotted line shows the external shape of the porous body 55*a* after infiltration shown in FIG. 15. As shown in FIG. 16, the bottom side of the porous body 55*b* being the other side of a contact was machined to form a shallow depression with a diameter of 20.5 mm and a depth of 3 mm. FIG. 17 is a cross-sectional view showing view of an electrode component produced by using the machined porous body shown in FIG. 16, Brazing was conducted with by a brazing material 56 inserted between the porous body 55*h* and a round-bar-Shaped conductor 57 composed of Cu. A contact member pair produced according to each of Examples 1 to 4 and Comparative example 3 was used to assemble a vacuum interrupter having a configurations shown in FIG. 14.

In order to evaluate the vacuum interrupters produced according to Examples 1 to 4 and Comparative example 3, interruption tests were conducted with a current carried between electrodes. In the interruption tests, a 12 kV/60 Hz power supply was used, and interruption trials were performed ten times at a same interruption current; if the current was successfully interrupted at a timing when becoming zero without re-igniting an arc, the trial result was regarded as successful. The interruption tests began with a current of 12 kA, and then the interruption current value was increased by 4 kA for the next test case until it reached 28 kA; in each interruption test case, unsuccessful interruptions were counted out of the ten trial results. Table 2 lists the results of the interruption tests. In the table, an unsuccessful (NG) count indicates the number of unsuccessful current interruptions and the number obtained by subtracting the unsuccessful count from ten is the number of successful (OK) interruptions.

At 20 kA, there was an unsuccessful interruption in Comparative example 3, but all ten interruptions were successful in each of Examples 1 to 3, where some interruptions became unsuccessful at 24 kA being the next case. At 28 kA, ten interruptions were unsuccessful in ten trials in Comparative example 3; however some interruptions were still successful in Examples, and especially in Example 3 having a thinnest contact portion, only one interruption was unsuccessful. This confirms that the current-interruption performances in Examples were improved as a whole. As confirmed in Table 1, this can be considered that the high-resistance contact part containing Cr became thinner in the whole electrode, bringing a contact resistance reduction effect. It can be further considered that: due to the contact resistance reduction, the temperature rise at the contact layer surface becomes lowered when carrying current; and thus, the temperature rise at the contact surface produced by an interruption-ignited arc becomes lowered; therefore, it becomes less likely that the contact material evaporated from the contact surface keeps the arc occurring, thereby improving the current-interruption performance.

TABLE 2

| samples | ON resistance before test | ON resistance after 12 kA interruption | test current 12 kA | 16 kA | 20 kA | 24 kA | 28 kA |
|---|---|---|---|---|---|---|---|
| Example 1 | 31 μΩ | 42 μΩ | NG: 0 times | NG: 0 times | NG: 0 times | NG: 1 times | NG: 3 times |
| Example 2 | 32 μΩ | 47 μΩ | NG: 0 times | NG: 0 times | NG: 0 times | NG: 1 times | NG: 4 times |
| Example 3 | 24 μΩ | 32 μΩ | NG: 0 times | NG: 0 times | NG: 0 times | NG: 0 times | NG: 1 times |
| Example 4 | 35 μΩ | 51 μΩ | NG: 0 times | NG: 0 times | NG: 1 times | NG: 2 times | NG: 7 times |
| Comparative example 3 | 47 μΩ | 69 μΩ | NG: 0 times | NG: 0 times | NG: 1 times | NG: 9 times | NG: 10 times |

Examples shown above are all about Embodiment 1, When the contact members according to Embodiment 2 are produced so as to have substantially the same shapes, results having the same tendency described above can be obtained.

(Example 5)

WC was used as a main constituent of the porous body. In order to facilitate Cu infiltration, Cu powder whose amount is 30 volume % of the WC was mixed. The average particle diameter of the used WC powder was 9 μm and the average particle diameter of the Cu powder added was 30 μm. The porosity was 35% of the whole volume of the porous body. A disk-shaped porous plate produced from this porous body had a diameter of 30 mm and a thickness of 4 mm. An opening at the center of the porous plate (center hole diameter) had a diameter of 5 mm. As for conditions for preliminarily sintering the porous body, the temperature was 1150 degrees C. and the temperature retention time was 5 hours. The inside of the mold was sprayed with BN powder as a release agent. In the mold, the bottom's diameter was 20 mm; the depth from the shelf to the bottom was 35 mm; the inner diameter at the shelf was 32 mm; and the height from the shelf to the mold's upper edge was 20 mm. Oxygen-free copper pellet were used as infiltrant; on the mold bottom, an oxygen-free copper pellet with the diameter of 18 mm and the height of 35 mm was placed, above which the porous plate was placed. Furthermore, on the porous plate, an oxygen-free copper pellet with the diameter of 25 mm and the height of 8 mm was placed. The temperature during infiltration was 1100 degrees C., which is slightly higher than the Cu melting point of 1083 degrees C. The infiltration was conducted for three hours in a hydrogen atmosphere. After infiltration, the contact material was taken out and machined into the shape shown in FIG. 1. The surface of the porous body was ground down by approximately 0.5 mm. The side face thereof was also ground so that the top surface would have a diameter of 28 mm; and the contact supporting part was tapered so that the side face thereof would be at approximately 80 degrees relative to the contact layer surface. A portion to be the contact-part holding conductor part was ground so as only to have a smooth surface with its diameter unchanged at 20 mm which was a diameter after the infiltration; and a tapped hole for joint was machined at the end opposite to the contact layer. After that, the contact-part holding conductor was joined with a screw 40 to a conductor (rod) to be pulled out through the metal lid to outside of a vacuum interrupter, and then the joined components were assembled into the vacuum interrupter.

COMPARATIVE EXAMPLE 4

A conventional method was used for infiltrating a porous body. The thickness of the porous body was 10 mm and the thickness of an infiltrant was 8 mm. As for the porous plate, a disk without an opening was produced. A mold was used whose shape corresponds to that of the disk. Except that, the conditions for infiltration were all the same as in Example 5. The infiltrated porous body was machined so as to have the thickness of 3.5 mm and the side face thereof was also ground that the top surface would have a diameter of 28 mm and the contact-layer supporting part was tapered so that the side face thereof would be at approximately 80 degrees relative to the contact layer surface. After that, the contact-part holding conductor was brazed to a conductor (rod) to be pulled out through the metal lid to outside of a vacuum interrupter, and then the brazed components were assembled into a vacuum interrupter.

In order to evaluate the vacuum interrupters produced according to Example 5 and Comparative example 4, interruption tests were conducted with a current carried between electrodes. In the interruption tests, a 7.2kV/60Hz power supply was used, and interruption trials were performed ten times at a same interruption current; if the current was successfully interrupted at a timing when becoming zero without re-igniting an arc, the trial result was regarded as successful. The interruption tests began with a current of 6 kA, and then the interruption current value was increased by 2 kA for a next test case until it reached 14 kA; in each interruption test case, unsuccessful interruptions were counted out of the ten trial results. Table 3 lists the results of the interruption tests.

At 10 kA, there was an unsuccessful interruption in Comparative example 4, but all ten interruptions were successful in Example 5, where some interruptions became unsuccessful at 12 kA being the next case. At 14 kA, ten interruptions were unsuccessful in ten trials in Comparative example 4; however an interruption was still successful in Example, this confirms that the current-interruption performances in Example were improved in general. This can be considered that because no brazing step was included in Example 5, the contact resistance was lowered. It can be further considered that: due to the contact resistance reduction, the temperature rise at the contact layer surface becomes lowered when carrying current; and thus, the temperature rise at the contact surface produced by an interruption-ignited arc becomes lowered; therefore, it becomes, less likely that the contact material evaporated from the contact surface keeps the arc occurring, thereby improving the current-interruption performance.

TABLE 3

| samples | ON resistance before test | ON resistance after 6 kA interruption | trial current 6 kA | 8 kA | 10 kA | 12 kA | 14 kA |
|---|---|---|---|---|---|---|---|
| Example 5 | 50 μΩ | 75 μΩ | NG: 0 times | NG: 0 times | NG: 0 times | NG: 3 times | NG: 9 times |
| Comparative example 4 | 58 μΩ | 80 μΩ | NG: 0 times | NG: 0 times | NG: 1 times | NG: 5 times | NG: 10 times |

DESCRIPTION OF SYMBOLS

10: vacuum interrupter,
11: interruption chamber,
12: insulated container,
13*a*, 13*b*: metal sealing part,
14*a*, 14*b*: metal lid,
16: contact member,
16*a*: fixed-element-side contact member,
16*b*: movable-element-side contact member,
17*a*: fixed-element-side conductor,
17*b*: movable-element-side conductor,
18: contact layer,
18*a*: fixed-element-side contact layer,
18*b*: movable-element-side contact layer,
19: bellows,
20: arc shield for bellows,
21: arc shield for insulated container,
22: contact-layer supporting part,
31: porous plate,
32: mold,
33: opening,
34: pellet,
35: infiltrated layer,
36: recess,
37: tapped hole,
38: contact-part holding conductor,
54: remaining infiltrant,
55*a*: porous body after infiltration,
55*b*: porous body after machining,
56: brazing material,
57: conductor

The invention claimed is:

1. A contact member to be used for a vacuum interrupter, comprising:

a contact layer composed of a plate-shaped porous body containing a high-melting-point metal as a main porous body constituent and infiltrated with an infiltrant containing a low-melting-point metal as a main infiltrant constituent;

a contact-layer supporting part in contact with the contact layer and composed of the infiltrant; and a contact-part holding conductor composed of the infiltrant, wherein the porous body is provided with an opening at the center of the contact layer and a portion from the opening to both the contact-layer supporting part and the contact-part holding conductor is a continuous body of the infiltrant, and wherein an average density of the porous body is smaller than a density of the infiltrant.

2. The contact member according to claim 1, wherein the main porous body constituent of the high-melting-point metal composing the porous body is Cr and the low-melting-point metal composing the infiltrant is Cu.

3. A contact member to be used for a vacuum interrupter, comprising:

a contact layer composed of a plate-shaped porous body containing a high-melting-point metal as a main porous body constituent and infiltrated with an infiltrant containing a low-melting-point metal as a main infiltrant constituent;

a contact-layer supporting part in contact with the contact layer and composed of the infiltrant; and a contact-part holding conductor composed of the infiltrant, wherein the porous body is provided with an opening at the center of the contact layer and a portion from the opening to both the contact-layer supporting part and the contact-part holding conductor is a continuous body of the infiltrant, and wherein an average density of the porous body is larger than a density of the infiltrant.

4. The contact member according to claim 3, wherein the main porous body constituent of the high-melting-point metal composing the porous body is WC and the low-melting-point metal composing the infiltrant is Cu.

5. A vacuum interrupter, wherein the contact member according to claim 1 is joined with a screw to a current-carrying conductor.

6. A vacuum interrupter, wherein the contact member according to claim 2 is joined with a screw to a current-carrying conductor.

7. A vacuum interrupter, wherein the contact member according to claim 3 is joined with a screw to a current-carrying conductor.

8. A vacuum interrupter, wherein the contact member according to claim 4 is joined with a screw to a current-carrying conductor.

* * * * *